US009336763B1

(12) United States Patent
Zhang

(10) Patent No.: US 9,336,763 B1
(45) Date of Patent: May 10, 2016

(54) COMPUTING DEVICE AND METHOD FOR PROCESSING MUSIC

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Xue-Qin Zhang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/584,566

(22) Filed: Dec. 29, 2014

(30) Foreign Application Priority Data

Oct. 28, 2014 (CN) ..... 2014 1 0593961

(51) Int. Cl.
*G10H 1/06* (2006.01)
*G10H 1/34* (2006.01)

(52) U.S. Cl.
CPC ..... *G10H 1/34* (2013.01)

(58) Field of Classification Search
CPC ..... G10H 1/0008; G10H 2220/015; G10H 1/0058; G10H 2230/015; G10H 1/0066; G10H 1/365; G10H 2210/086; G10H 2240/056; G10H 2240/311; G10H 7/00; G10H 1/0033; G10H 1/186; G10H 2220/231; G09B 15/003; G10G 1/00; G10G 1/02; G10G 3/04; G06N 7/06
See application file for complete search history.

(56) References Cited

U.S. PATENT DOCUMENTS 5,533,903 A * 7/1996 Kennedy ..... G09B 5/065 345/473
5,693,903 A * 12/1997 Heidorn ..... G10H 1/361 84/609
6,066,791 A * 5/2000 Renard ..... G09B 15/002 84/470 R
6,169,239 B1 * 1/2001 Aiardo ..... G09B 15/023 84/464 A
2004/0049540 A1 * 3/2004 Wood ..... G10H 1/0058 709/203
2004/0069122 A1 * 4/2004 Wilson ..... G10H 1/0058 84/609
2006/0117935 A1 * 6/2006 Sitrick ..... G09B 15/023 84/477 R
2006/0156906 A1 * 7/2006 Haeker ..... G10H 1/0008 84/609
2007/0227335 A1 * 10/2007 Fukada ..... G10H 1/0008 84/600
2011/0283867 A1 * 11/2011 Ihara ..... G09B 15/08 84/478
2012/0234159 A1 * 9/2012 Forrest ..... G10C 3/12 84/625

* cited by examiner

*Primary Examiner* — Marlon Fletcher
(74) *Attorney, Agent, or Firm* — Novak Druce Connolly Bove + Quigg LLP

(57) ABSTRACT

A computing device converts each input signal corresponding to a key of a music keyboard into a tone of the musical instrument associated with the key. The computing device outputs each tone of the musical instrument using an audio device connected to the computing device. The computing device converts each tone of the musical instrument into a note and stores the note into a musical score.

15 Claims, 5 Drawing Sheets

COMPUTING DEVICE AND METHOD FOR PROCESSING MUSIC

CROSS-REFERENCE TO RELATED APPLICATIONS

This application claims priority to Chinese Patent Application No. 201410593961.8 filed on Oct. 28, 2014, the contents of which are incorporated by reference herein.

FIELD

Embodiments of the present disclosure relate to music processing technology, and particularly to a computing device and a method for processing music.

BACKGROUND

A musician may create and/or play music using various musical instruments, such as an electronic organ, a piano, a dulcimer, a guitar, a drum or the like. When creating the music the musician may need to write a musical score for each instrument used in playing the music.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
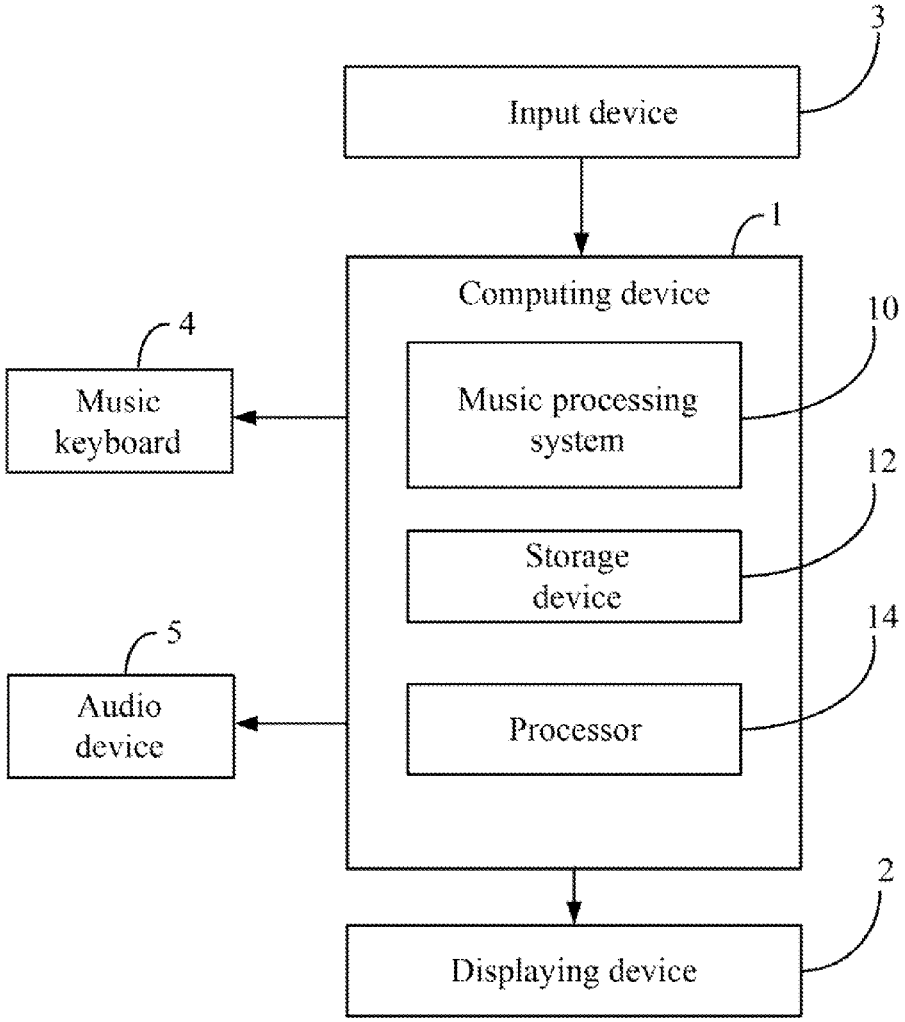
FIG. 1 is a block diagram of an example embodiment of a computing device connected to a music keyboard and an audio device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented. The term "module" refers to logic embodied in computing or firmware, or to a collection of software instructions, written in a programming language, such as, Java, C, or assembly. One or more software instructions in the modules may be embedded in firmware, such as in an erasable programmable read only memory (EPROM). The modules described herein may be implemented as either software and/or computing modules and may be stored in any type of non-transitory computer-readable medium or other storage device. Some non-limiting examples of non-transitory computer-readable media include CDs, DVDs, BLU-RAY™, flash memory, and hard disk drives. The term "comprising" means "including, but not necessarily limited to"; it specifically indicates open-ended inclusion or membership in a so-described combination, group, series and the like.

FIG. 1 is a block diagram of an example embodiment of a computing device 1 connected to a music keyboard 4 and an audio device 5. In at least the embodiment, the computing device 1 provides functions of connections, so that a displaying device 2, an input device 3, the music keyboard 4 and an audio device 5 can be connected to the computing device 1 using a wire connection, such as a cable, or a wireless connection, such as, a WIFI connection, or a BLUETOOTH connection.

The input device 3, such as a keyboard and/or a mouse, can be used to input various computing device signals or software interfaces. The computing device 1 provides an operation interface for a user to control one or more operations of the computing device 1.

Figure 3:
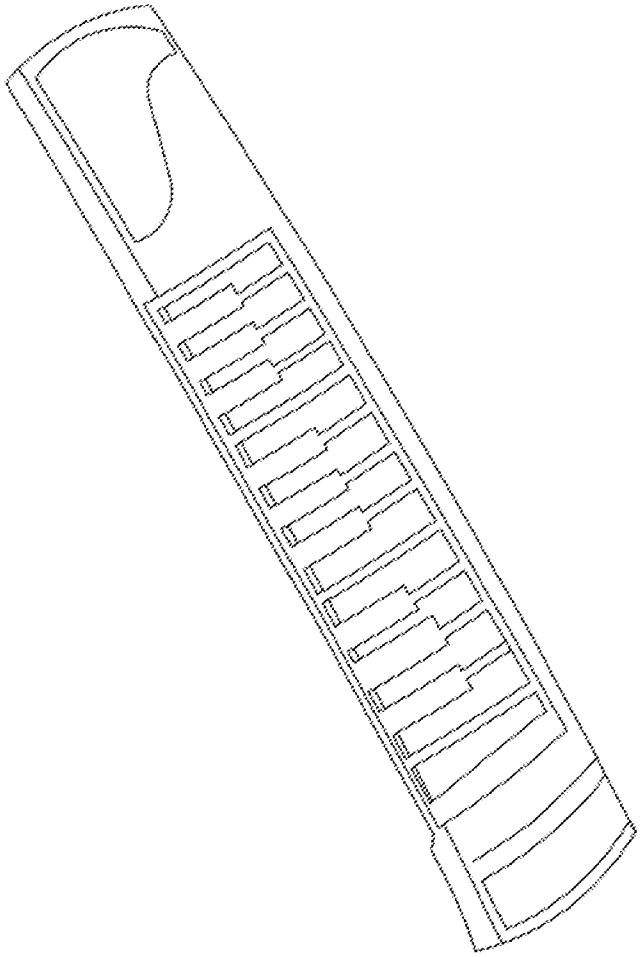
FIG. 3 shows a diagrammatic view of an example of the music keyboard.
Figure 4:
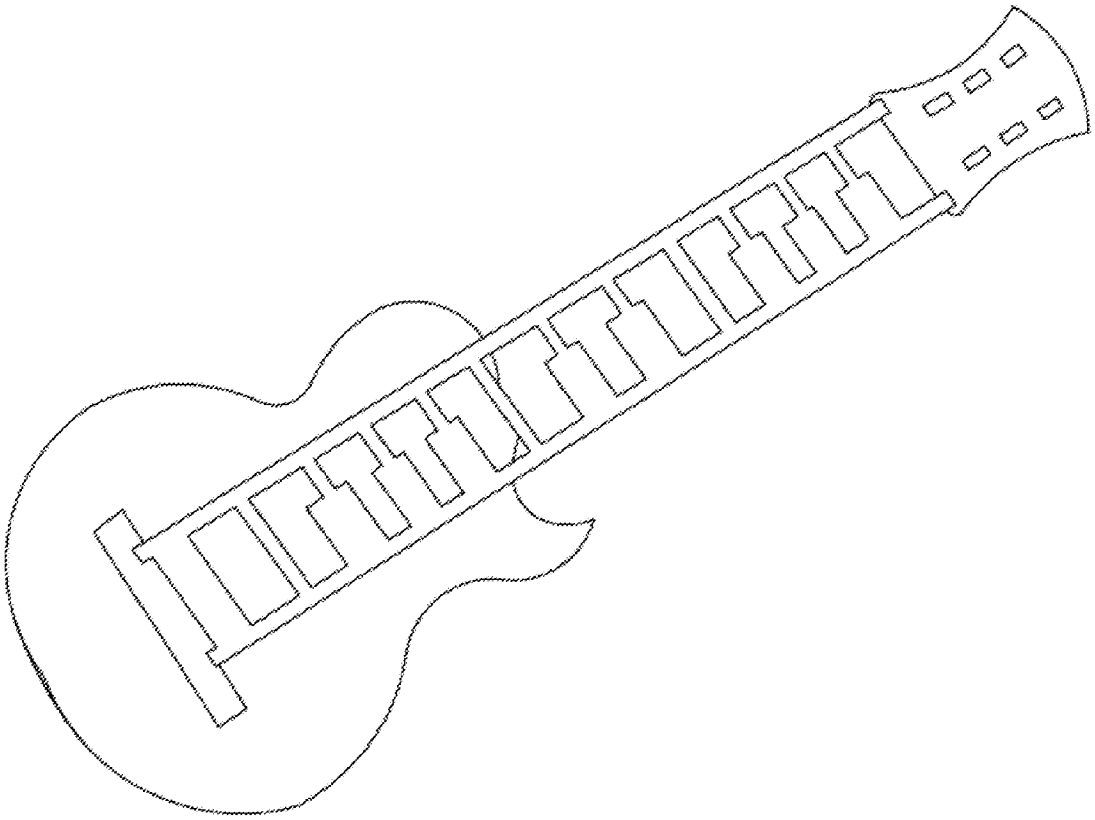
FIG. 4 shows a diagrammatic view of another example of the music keyboard.

The music keyboard 4 is used to simulate various musical instruments, such as an electronic organ, a piano, a dulcimer, a guitar, drum or the like. In at least one embodiment, the music keyboard 4 can be made in a shape of the dulcimer as shown in FIG. 3. In at least another embodiment, the music keyboard 4 can be made in a shape of the guitar as shown in FIG. 4. The music keyboard 4 can includes, but not limited to, 38 keys, 48 keys, 61 keys, or 88 keys according to the musical instruments which the music keyboard 4 is simulating. For example, if the music keyboard 4 is simulating the piano, and the music keyboard includes 88 keys. Furthermore, the music keyboard 4 is used to generate sounds of various musical instruments, such as sound of the electronic organ, sound of the piano, sound of the dulcimer, sound of the guitar or the like. If the music keyboard 4 is simulating the piano, and the music keyboard generates the sound of the piano.

The audio device 5 is used to play the sound which is generated by the music keyboard 4. The audio device 5 can be, but is not limited to, a speaker, a sound box or the like. In addition, the audio device 5 can be integrated into the music keyboard 4, and become a part of the music keyboard 4.

In at least one embodiment, the computing device 1 includes, but is not limited to, a music processing system 10, a storage device 12, and at least one processor 14. The computing device 1 can be, but is not limited to, mobile phones, tablet computers, personal digital assistants (PDAs), personal computers or any other computing devices which provide functions of network connections. FIG. 1 illustrates only one example of the computing device 1, and other examples can comprise more or fewer components that those shown in the embodiment, or have a different configuration of the various components.

In one embodiment, the storage device 12 can be an internal storage device, such as a flash memory, a random access memory (RAM) for temporary storage of information, and/or a read-only memory (ROM) for permanent storage of information. The storage device 12 can also be an external storage device, such as an external hard disk, a storage card, or a data storage medium. The at least one processor 14 can be a central processing unit (CPU), a microprocessor, or other data processor chip that performs functions of the computing device 1. In addition, the storage device 12 stores tones of each musical instrument. For example, the storage device 12 stores 88 tones of the piano.

Figure 2:
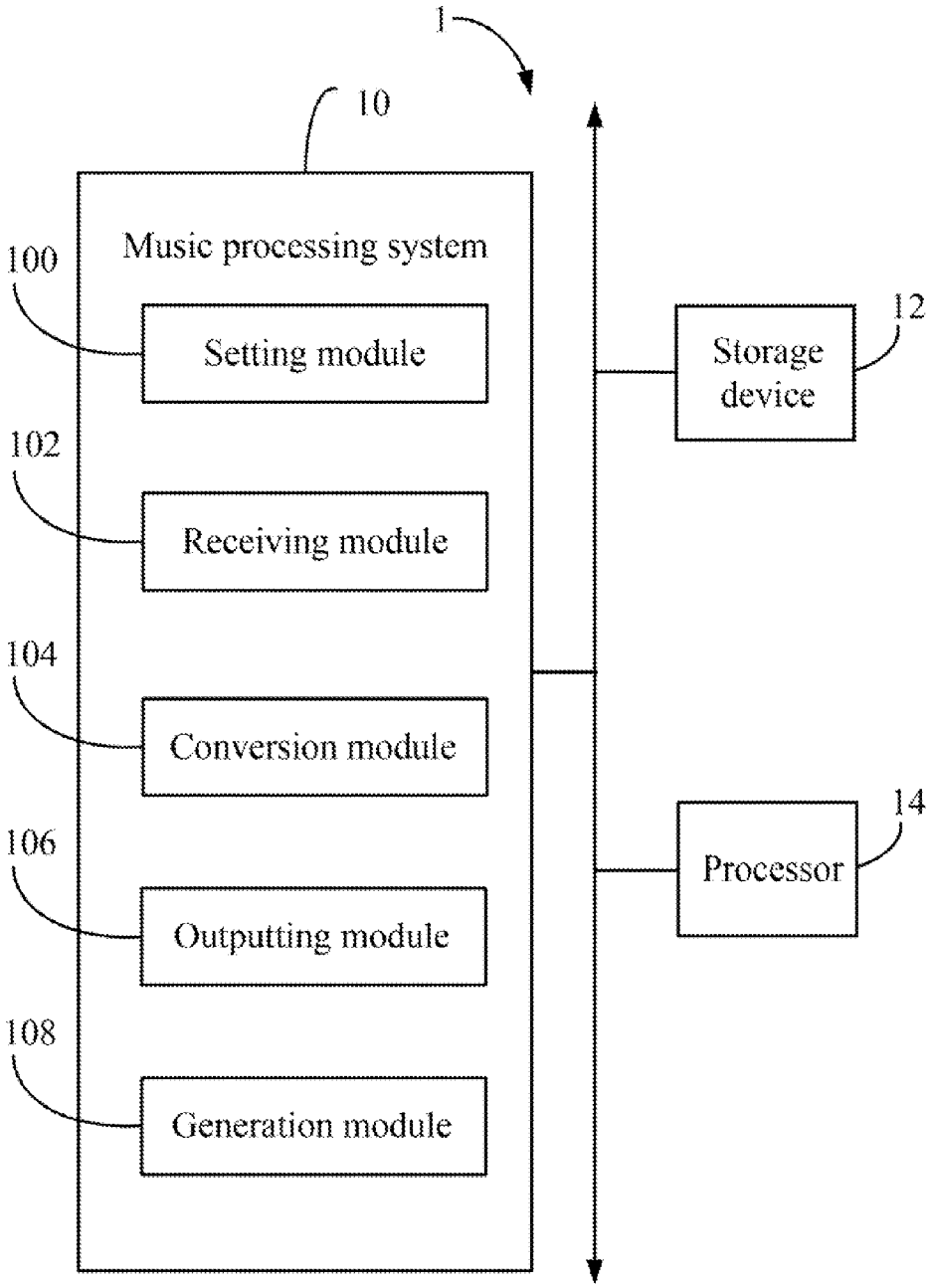
FIG. 2 is a block diagram of an example embodiment of a music processing system in the computing device in FIG. 1.

FIG. 2 is a block diagram of an example embodiment of a music processing system in a computing device 1. The music processing system 10 comprises, but is not limited to, a setting module 100, a receiving module 102, a conversion module 104, an output module 106, and a generation module 108. Modules 100-108 can comprise computerized instructions in the form of one or more computer-readable programs that can be stored in a non-transitory computer-readable medium, for example the storage device 12, and executed by the at least one processor 14 of the computing device 1. A detailed description of the functions of the modules 100-108 is given below in reference to FIG. 1.

Figure 5:
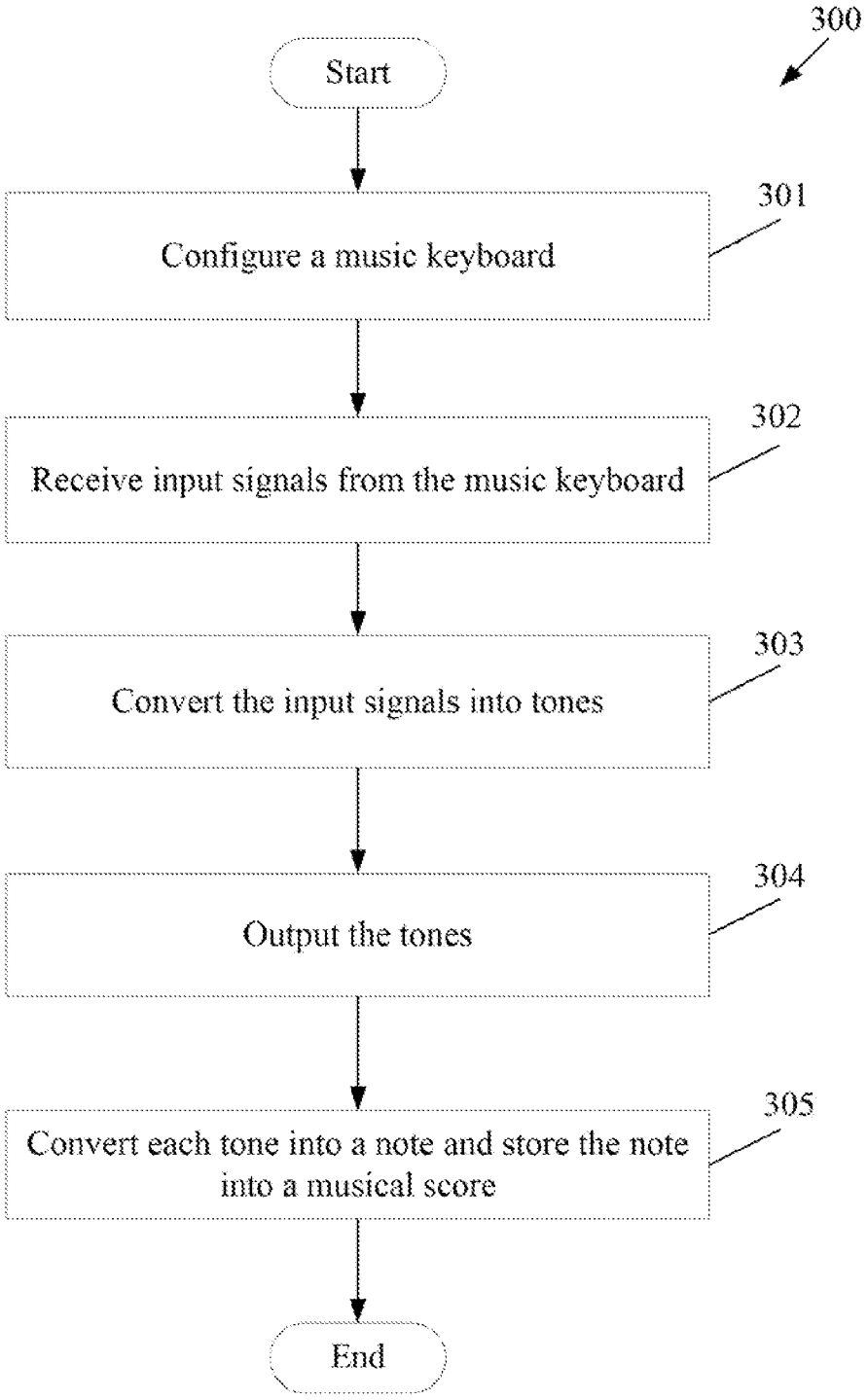
FIG. 5 is a flowchart of an example embodiment of a method for processing music.

FIG. 5 illustrates a flowchart of an example embodiment of a method for processing music using a computing device. In an example embodiment, the method 300 is performed by execution of computer-readable software program codes or instructions by at least one processor of the computing device 1.

Referring to FIG. 5, a flowchart is presented in accordance with an example embodiment. The method 300 is provided by way of example, as there are a variety of ways to carry out the method. The method 300 described below can be carried out using the configurations illustrated in FIG. 1, for example, and various elements of these figures are referenced in explaining method 300. Each block shown in FIG. 5 represents one or more processes, methods, or subroutines, carried out in the method 300. Furthermore, the illustrated order of blocks is illustrative only and the order of the blocks can be changed. Additional blocks can be added or fewer blocks can be utilized without departing from this disclosure. The example method 300 can begin at block 301.

At block 301, a setting module configures the music keyboard to simulate a musical instrument. In at least one embodiment, the music keyboard is simulating the musical instrument upon a condition that keys of the music keyboard are selected and each selected key is associated with a tone of the musical instrument. That is, the tone of the musical instrument is generated when the selected key corresponding to the tone of the musical instrument is pressed. For example, if the music keyboard is simulating a piano, 88 keys of the music keyboard are selected and each of 88 keys of the music keyboard is associated with a tone of the piano.

At block 302, a receiving module receives input signals from the music keyboard when the keys of the music keyboard are pressed. In at least one embodiment, the input signals are generated when the keys of the music keyboard are pressed by fingers of a user. Each input signal includes a name of the key of the music keyboard which is pressed. For example, if the user presses the C key an input signal is generated and sent to the computing device and the input signal includes the name of the C key. In addition, the more strength that the user uses to press the selected keys of the music keyboard is, the stronger the input signal.

At block 303, a conversion module converts each input signal corresponding to the key into a tone of the musical instrument associated with the key. In at least one embodiment, due to each input signal including the name of the key, the conversion module searches for the tone according to a name of the key in the storage device 12.

At block 304, an outputting module outputs each tone of the musical instrument using an audio device. In at least one embodiment, each tone of the musical instrument is played using the audio device when the tone of the musical instrument is sent to the audio device.

At block 305, a generation module converts each tone of the musical instrument into a note and stores the note into a musical score. The musical score can be, but is not limited to, a numbered musical notation, or a score. The musical score can be displayed in a displaying device and stored as a file in a format, such as a portable document format (PDF), a TXT format, or an image. The musical score can be generated in real-time when the keys of the music keyboard are pressed. Furthermore, the musical score can be generated after the keys of the music keyboard are pressed more than a predetermined time (for example, five minutes). The user can read the musical score when the user uses the music keyboard to play a song. In addition, the generation module further generates an audio file which includes the tones of the musical instrument. The audio file can be, but is not limited to, an audio video interleaved (AVI) file, a moving picture experts group audio layer III (MP3) file, a shock wave flash (SWF) file, a JPG file, a musical instrument digital interface (MID) file or any other audio file.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in particular the matters of shape, size and arrangement of parts within the principles of the present disclosure, up to and including the full extent established by the broad general meaning of the terms used in the claims.

What is claimed is:

1. A computing device, comprising:

at least one processor; and a storage device that stores one or more programs, which when executed by the at least one processor, cause the at least one processor to:

configure a music keyboard connected to the computing device to simulate one of several musical instruments upon a condition that an amount of keys of the music keyboard are selected and each of the selected keys is associated with a tone of the simulated musical instrument, wherein the musical instruments comprise an electronic organ, a dulcimer, a guitar and drum;

receive input signals from the music keyboard when keys of the music keyboard are pressed;

convert each input signal corresponding to a key into a tone of the simulated musical instrument associated with the key;

output each tone of the simulated musical instrument using an audio device connected to the computing device; and convert each tone of the simulated musical instrument into a note and store the note into a musical score.

2. The computing device of claim 1, wherein the input signals are generated when the keys of the music keyboard are pressed.

3. The computing device of claim 2, wherein each input signal comprises a name of the key of the music keyboard which is pressed.

4. The computing device of claim 1, wherein the musical score is a numbered musical notation or a staff.

5. The computing device of claim 1, wherein the at least one processor further generates an audio file which comprises the tones of the musical instrument.

6. A computer-based method for processing music using a computing device, the method comprising:

configuring a music keyboard connected to the computing device to simulate one of several musical instruments upon a condition that an amount of keys of the music keyboard are selected and each of the selected keys is associated with a tone of the simulated musical instrument, wherein the musical instruments comprises an electronic organ, a dulcimer, a guitar and drum;

receiving input signals from the music keyboard when keys of the music keyboard are pressed;

converting each input signal corresponding to a key into a tone of the simulated musical instrument associated with the key;

outputting each tone of the simulated musical instrument using an audio device connected to the computing device; and converting each tone of the simulated musical instrument into a note and storing the note into a musical score.

7. The method of claim 6, wherein the input signals are generated when the keys of the music keyboard are pressed.

8. The method claim 7, wherein each input signal comprises a name of the key of the music keyboard which is pressed.

9. The method of claim 6, wherein the musical score is a numbered musical notation or a staff.

10. The method of claim 6, further comprising:

generating an audio file which comprises tones of the musical instrument.

11. A non-transitory computer-readable medium having stored thereon instructions that, when executed by at least one processor of a computing device, causing the computing device to perform a method for processing music, the method comprising:

configuring a music keyboard connected to the computing device to simulate one of several musical instruments upon a condition that an amount of keys of the music keyboard are selected and each of the selected keys is associated with a tone of the simulated musical instrument, wherein the musical instruments comprises an electronic organ, a dulcimer, a guitar and drum;

receiving input signals from the music keyboard when keys of the music keyboard are pressed;

converting each input signal corresponding to a key into a tone of the simulated musical instrument associated with the key;

outputting each tone of the simulated musical instrument using an audio device connected to the computing device; and converting each tone of the simulated musical instrument into a note and storing the note into a musical score.

12. The non-transitory computer-readable medium of claim 11, wherein the input signals are generated when the keys of the music keyboard are pressed.

13. The non-transitory computer-readable medium of claim 12, wherein each input signal comprises a name of the key of the music keyboard which is pressed.

14. The non-transitory computer-readable medium of claim 11, wherein the musical score is a numbered musical notation or a staff.

15. The non-transitory computer-readable medium of claim 11, wherein the method further comprises:

generating an audio file which comprises tones of the musical instrument.

* * * * *